United States Patent [19]

Gutner

[11] 4,189,796

[45] Feb. 26, 1980

[54] ADJUSTABLE MECHANISM FOR GUARD RAIL OF A BUNK BED

[76] Inventor: Kenneth H. Gutner, 3285 Dato, Highland Park, Ill. 60035

[21] Appl. No.: 927,487

[22] Filed: Jul. 24, 1978

[51] Int. Cl.[2] ..... A47C 17/40; A47C 21/00

[52] U.S. Cl. ..... 5/8; 5/100; 5/428; 248/221.3

[58] Field of Search ..... 5/819, 294–296, 5/331, 100, 201; 108/108, 109, 152; 248/73, 221.3; 312/111, 257 R, 263

[56] References Cited

U.S. PATENT DOCUMENTS

| | | | |
|---|---|---|---|
| 739,020 | 9/1903 | Nichols | 5/296 |
| 2,931,053 | 4/1960 | Andreasom | 5/201 |
| 2,994,888 | 8/1961 | Minuti | 5/296 |
| 3,008,534 | 11/1961 | Von Canon, Jr. | 5/8 X |
| 3,113,358 | 12/1963 | Zell et al. | 248/221.3 |
| 3,388,884 | 6/1968 | Eggler et al. | 248/221.3 |
| 3,422,775 | 1/1969 | Johnsson | 108/109 |
| 3,780,386 | 12/1973 | Fouks et al. | 5/296 |

*Primary Examiner*—Casmir A. Nunberg
*Attorney, Agent, or Firm*—Tilton, Fallon, Lungmus & Chestnut

[57] ABSTRACT

An adjustable mechanism for a bed guard rail including generally planar male and female parts, the male part having a generally L-shaped tongue struck therefrom and the female part being elongated and equipped with a plurality of longitudinally aligned, spaced apart notches each defining tongue engaging edges.

6 Claims, 5 Drawing Figures

ADJUSTABLE MECHANISM FOR GUARD RAIL OF A BUNK BED

BACKGROUND AND SUMMARY OF INVENTION

This invention relates to an adjustable mechanism for a bed guard rail and, more particularly, to a novel locking mechanism for securing an adjustable guard rail to a bunk bed.

In bunk beds, the guard rail normally provided is required to extend approximately 4" above the mattress. This has caused concern because the thickness of the mattress can vary over a sizeable range, viz., 3–9". Thus, the art has either had to go to an extremely large (thus, costly and awkward) guard rail or one that is adjustable. No satisfactory adjustable rail has been provided and the provision of such an arrangement constitutes an important object of this invention.

The inventive adjustable mechanism for the guard rail includes generally planar male and female parts, one for each end of the guard rail and one for each post or other securing portion of the bunk bed itself. The female portion is relatively elongated and is equipped with a plurality of longitudinally spaced apart notches, each providing an edge suitable for receiving a hook or L-shaped tongue. The male part, on the other hand, has struck therefrom an L-shaped tongue for coaction with the edge of the female part. Additionally, the two parts have cooperating detent means to further secure the interconnection of the two and the female part is advantageously equipped with integral flanges projecting rearwardly along the longitudinal side edges which serve the purpose of both rigidifying the female part and also providing a positive spacing of the female part away from the bed post or like member so as to efficiently receive the L-shaped tongue.

Other advantages and objects of the invention may be seen in the details of construction and operation set down in the ensuing specification.

DETAILED DESCRIPTION

Figures 1, 1A:
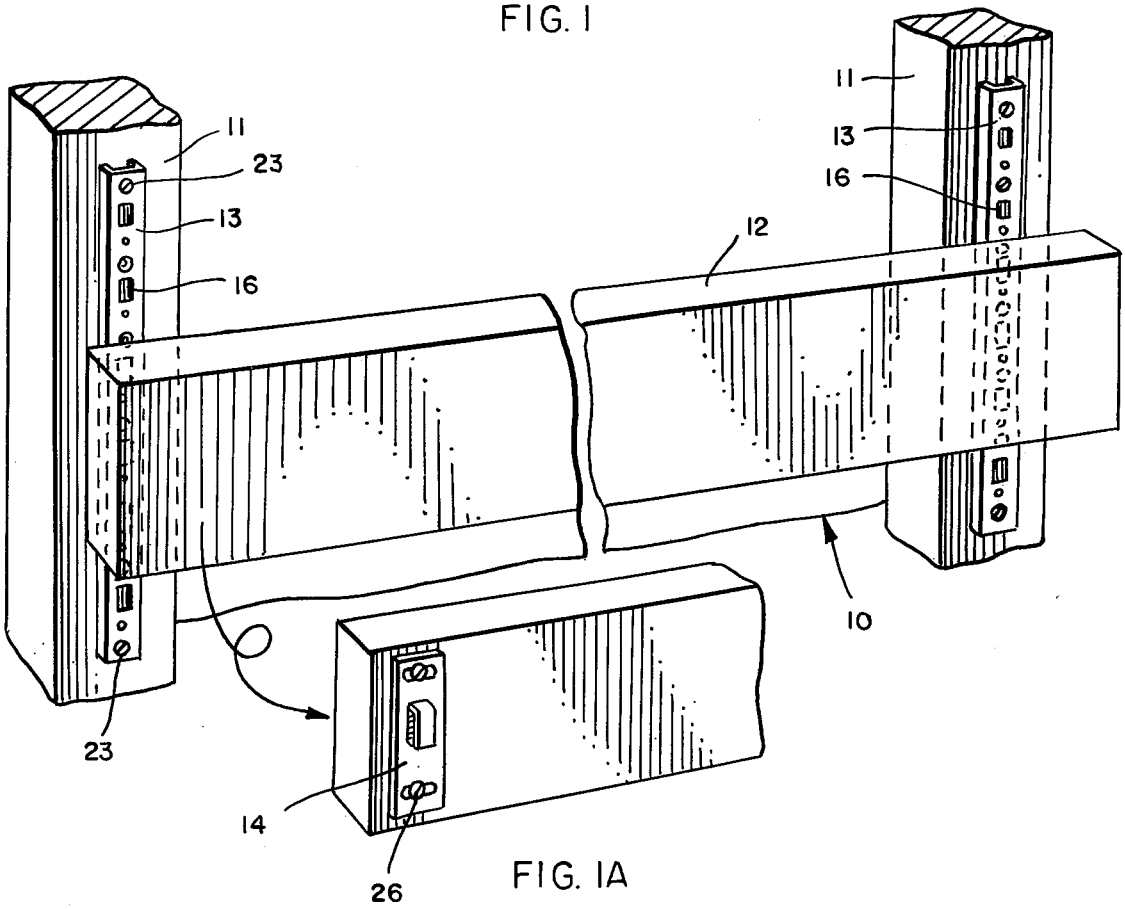
Figure 2:
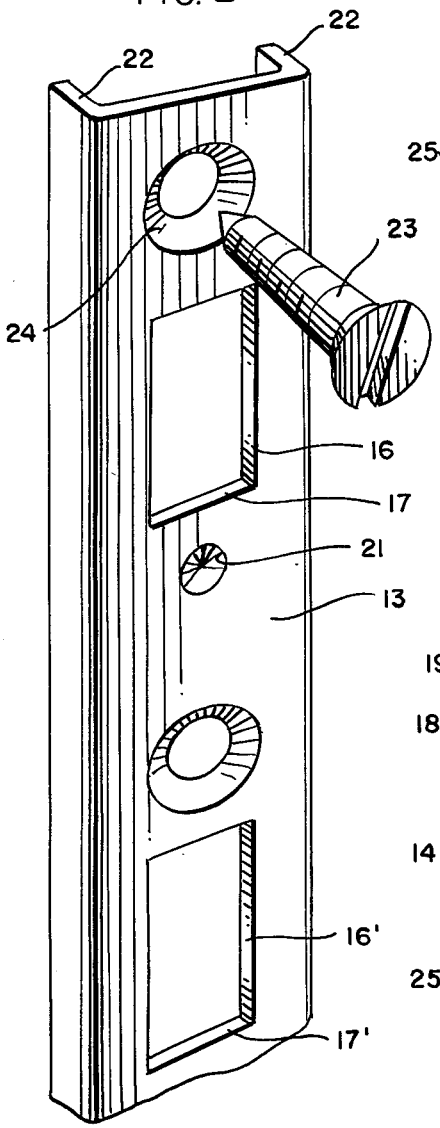
Figure 3:
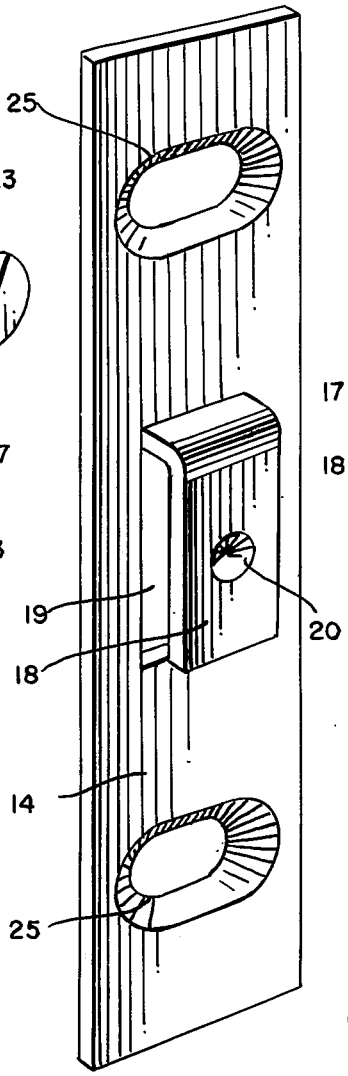
Figure 4:
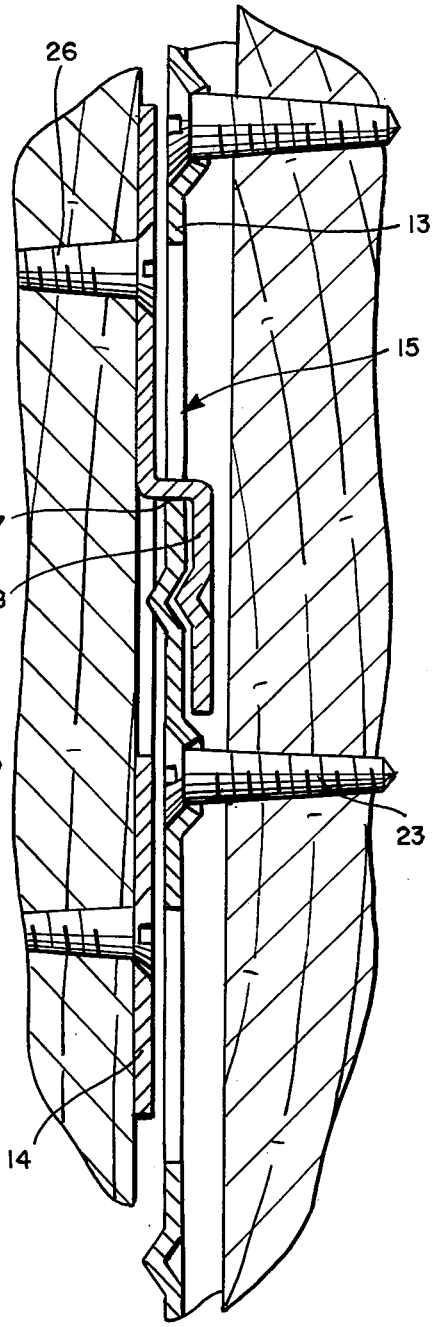

The invention is described in conjunction with an illustrative embodiment in the accompanying drawing, in which FIG. 1 is a fragmentary perspective view of a guard rail and bunk bed employing an adjustable mechanism constructed according to the teachings of this invention wotj FIG. 1A showing a fragment of the other side of the rail;

FIGS. 2 and 3 are perspective views of the female and male parts of the invention, respectively; and FIG. 4 is an enlarged fragmentary vertical sectional view showing the parts interconnected.

In the illustration given and with reference first to FIG. 1, the numeral 10 designates generally a bunk bed, the upper portion of which is only seen in FIG. 1. The bed 10 includes posts 11 and a guard rail 12. The posts 11 are each equipped with a female part 13 which constitutes, along with the male part 14, (see FIG. 1A) the adjustable mechanism generally designated 15 (see FIG. 4) of the instant invention.

Each of the parts 13 and 14 is generally planar, viz., plate-like. The female part 13 has metal struck therefrom at longitudinally spaced intervals as at 16, 16', etc. (see FIG. 2). The metal struck therefrom provides a ledge 17, 17', etc., which accommodates the receipt of an L-shaped hook or tongue 18 which is struck from the male part 14, leaving an opening 19.

Advantageously, the L-shaped tongue 18 is equipped with an inwardly directed detent 20 (see particularly FIG. 3) which mates with a correspondingly contoured detent 21 provided in the female member 13 (see FIG. 2)—this when the tongue 18 is resting on the edge 17 as depicted in FIG. 4.

The female part 13 is equipped along its longitudinal side edges with integral flanges as at 22 (see FIG. 2) which serve the dual purpose of spacing the tongue engaging edges 17 from the post 11 while strengthening the female part 13 against distortion. Here it will be appreciated that although strong, attractive hardware is desirable, cost is always a consideration and therefore metal of lighter gauges is usually preferred—but with the attendant risk of distortion upon loading.

In the operation of the invention, the female parts 13 are secured to the posts 11 by wood screws 23 extending through countersunk openings 24.

Because the female part 13 is equipped with a plurality of notches, the guard rail carrying the male part 14 may be adjusted upwardly or downwardly as desired to engage different of the notches 16, 16', etc.

The male part 14 is equipped with a pair of transversely elongated openings 25 (see FIG. 3) for the receipt of wood screws 26 (see FIGS. 1A and 4). This permits adjustability of the part 14 relative to the rail 12 and further relative to the female parts 13. It will be appreciated that the parts 13 may be out of plumb either due to error in installation, subsequent warpage, or other distortion of the bed frame including the posts 11. Therefore, the adjustability feature insures proper connection of the parts 13 and 14 under all conditions and insures that the detents 20 and 21 can snap together for a secure lock.

It will be appreciated that in some instances the parts may be reversed, i.e., mounting the male part on the bed. Further, the female part may have elongated openings in place of those designated 24.

While in the foregoing specification, a detailed description of an embodiment of the invention has been set down for the purpose of illustration, many variations in the details hereingiven may be made by those skilled in the art without departing from the spirit and scope of the invention.

I claim:

1. In a bunk bed having vertically-extending end post members and a horizontal guard rail member releasably connected to said post members, a pair of horizontally spaced apart releasable locks connecting said guard rail member to said post members, each lock comprising a female part on one of said members and a male part on the other, said male part comprising a relatively elongated, generally planar plate having a plurality of longitudinally aligned, spaced notches therein each defining tongue-engaging edges whereby said tongue is positionable at a plurality of locations on said female part to adjust the relationship of said members, said female part being equipped with means for mounting said female part on one of said members to space said tongue engaging edges from said one member to accommodate introduction of said tongue between said one member and one of said tongue engaging edges.

2. The structure of claim 1 in which said mounting means includes integral flanges on the longitudinal edges of said female parts, said flanges thereby spacing said tongue engaging edges from said one member while strengthening said female part against distortion.

3. The structure of claim 1 in which each of said parts is equipped with detent means for releasably locking the parts in selective positions.

4. The structure of claim 3 in which said detent means includes one detent on said tongue and a plurality of detents mateable therewith on said female part, one each below each tongue engaging edge.

5. The structure of claim 1 in which said parts are equipped with screw-receiving openings for mounting said parts on said members, said parts being elongated and the openings in one of said parts being transversely elongated to provide adjustability thereof.

6. The structure of claim 5 in said one part is said male part.

* * * * *